United States Patent [19]

Diep

[11] Patent Number: 4,678,481

[45] Date of Patent: Jul. 7, 1987

[54] $H_2O_2$ AS A CONDITIONING AGENT FOR ELECTROSTATIC PRECIPITATORS

[75] Inventor: Daniel V. Diep, Aurora, Ill.

[73] Assignee: Nalco Chemical Company, Naperville, Ill.

[21] Appl. No.: 902,847

[22] Filed: Sep. 2, 1986

[51] Int. Cl.[4] ..... B03C 3/01

[52] U.S. Cl. ..... 55/4; 55/8; 423/242

[58] Field of Search ..... 55/4, 8, 122; 423/242 R

[56] References Cited

U.S. PATENT DOCUMENTS

| | | | |
|---|---|---|---|
| 3,503,704 | 3/1970 | Marks | 55/8 X |
| 3,704,569 | 12/1972 | Hardison et al. | 55/4 |
| 3,722,178 | 3/1973 | Aaland et al. | 55/4 |
| 3,760,061 | 9/1973 | Hammond | 423/242 R |

*Primary Examiner*—Kathleen J. Prunner

*Attorney, Agent, or Firm*—John G. Premo; Anthony L. Cupoli; Donald G. Epple

[57] ABSTRACT

A method of improving the efficiency of electrostatic precipitators for removing high resistivity particulate matter from flue gases by treating said flue gases prior to contact with the electrostatic precipitator with an aqueous solution of hydrogen peroxide with the ratio of hydrogen peroxide to $SO_3$ being on a weight basis of at least 0.5/1.

1 Claim, 3 Drawing Figures

PILOT ELECTROSTATIC PRECIPITATOR

FIG.1 BENCH MINI-SCRUBBER
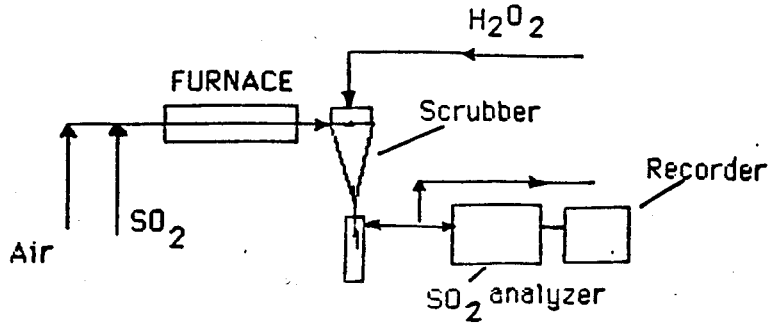
FIG.2 MINI COMBUSTOR
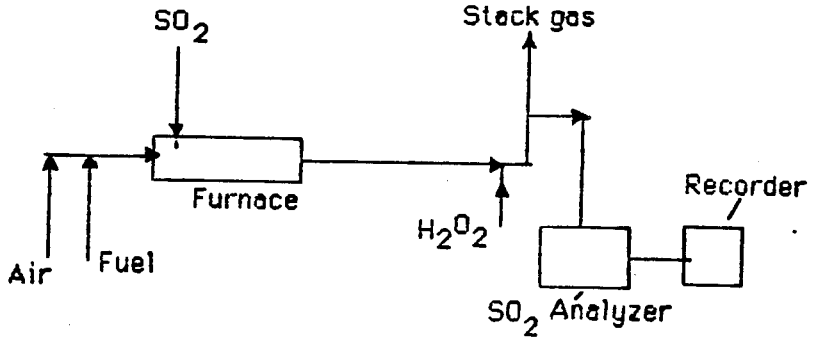
FIG.3 PILOT ELECTROSTATIC PRECIPITATOR
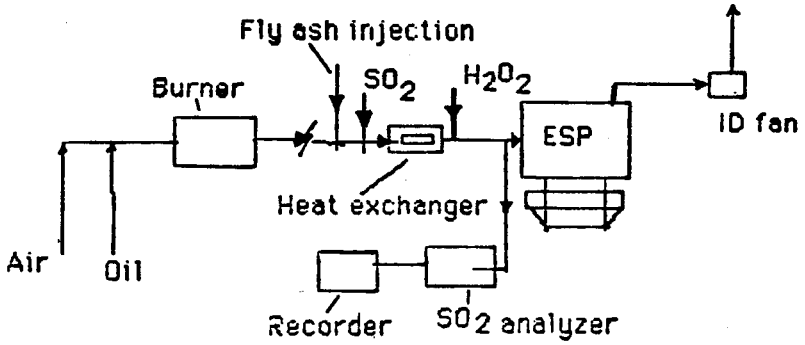

$H_2O_2$ AS A CONDITIONING AGENT FOR ELECTROSTATIC PRECIPITATORS

INTRODUCTION

One of the problems relating to the collection efficiency of electrostatic precipitators, ESPs, is the high particulate resistivity when the boiler burns low sulfur western coal. High fly ash resistivity affects an ESP efficiency principally by limiting the voltage and current at which the precipitator operates. (See L. A. Midkiff, Flue-gas Conditioning Upgrades Performance, Cuts Down Size of Precipitators, *Power*, April 1979, p. 99.) Commercial conditioning agents are sulfur trioxide ($SO_3$), sulfuric acid ($H_2SO_4$), ammonia, ammonium sulfate, etc. They are injected into the flue gas in the form of either a fine powder or an aqueous solution.

The present invention relates to the discovery that with a small dosage of hydrogen peroxide, $H_2O_2$, (10–50 ppm), the amount of $SO_3/H_2SO_4$ in the flue gas can be increased effectively by oxidizing the existing sulfurdioxide ($SO_2$) to $SO_3/H_2SO_4$ without introducing additional sulfur sources.

THE INVENTION

A method of improving the efficiency of electrostatic precipitators for removing high resistivity particulate matter from flue gases by treating said flue gases prior to contact with the electrostatic precipitator with an aqueous solution of hydrogen peroxide ($H_2O_2$) with the ratio of $H_2O_2$ to $SO_3$ being on a weight basis of at least 0.5/1.

The concentration of the $H_2O_2$ can vary between 2 percent by weight up to its solubility in water. A preferred concentration is between 15 and 30 percent by weight.

The amount of $H_2O_2$ used to treat the $SO_3$ in the flue gas may be as little as 0.5 parts per weight to 1 part per weight of $SO_3$. The dosage may be varied to provide a weight ratio of $H_2O_2$ to $SO_3$ of from 0.5/1 to 2/1.

The peroxide effectively and efficiently converts the $SO_2$ to $SO_3$ when the flue gas is at a temperature of about 300° to 400° F.

The overall reactions of $H_2O_2$ can be simplified to 5 general types as follows*:

| | |
|---|---|
| Decompositon | $2\ H_2O_2 \rightarrow 2\ H_2O + O_2$ |
| Molecular Addition | $H_2O_2 + Y \rightarrow Y.H_2O_2$ |
| Substitution | $H_2O_2 + RX \rightarrow ROOH + HX$ or $H_2O_2 + 2\ RX \rightarrow ROOR + 2\ HX$ |
| $H_2O_2$ as Reducing Agent | $H_2O_2 + Z \rightarrow ZH_2 + O_2$ |
| $H_2O_2$ as Oxidizing Agent | $H_2O_2 + W \rightarrow WO + H_2O$ |

*From Encyclopedia Chem. Tech., Vol. 11, p. 394 (1966)

As an oxidizing agent, peroxide reacts with the $SO_2$ in flue gas according to the reaction: $H_2O_2 + SO_2 \rightarrow SO_3 + H_2O$, or it may decompose or dissociate into the oxygen atom in the flue gas before it reacts with $SO_2$. Stoichiometric ratio of the above reaction is 1/1 as a molar ratio or 1/1.88 as a weight ratio of $H_2O_2/SO_2$. The conversion efficiency of $SO_2$ (ppm) to $SO_3$ (ppm) is defined as:

$$E\,\% = \frac{SO_2\,(\text{initial}) - SO_2\,(\text{final})}{SO_2\,(\text{initial})} \times 100 \qquad (1)$$

EVALUATION OF THE INVENTION

1. Bench Mini-scrubber:

Oxidation of $SO_2$ to $SO_3$ was done with a bench scale, spray type scrubber in which $SO_2$ gas was mixed with fine droplets of $H_2O_2$ solution. The general arrangement of the bench mini-scrubber is shown in FIG. 1. The apparatus consists of three main parts:

Furnace
Scrubber
$SO_2$ analyzer.

A flow of 12 SCFH of diluted $SO_2$ (3000 ppm) was passed through the electrically heated furnace which was preset at around 1500° F. The gas mixture then entered the scrubber. The scrubber is a spray type of 8" height, 1½" inside diameter. Hydrogen peroxide solution was sprayed from the top of the scrubber and reacted with the incoming $SO_2$ to form $SO_3/H_2SO_4$. The hot gas was cooled as it passed the condenser. About 2 SCFH of the exhaust gas was introduced into the $SO_2$ analyzer (Thermo Electron's pulsed fluorescent $SO_2$ analyzer). Gas temperature at the scrubber inlet was from 300° F. to 400° F.

Measurement of the baseline $SO_2$ concentration (in ppm) started after the steady state condition of the system was reached. Hydrogen peroxide (30% solution) was then injected into the scrubber. The treatment dosages were from 1/2 to 1/1 by weight ratio of $H_2O_2/SO_2$. The conversion of $SO_2$ to $SO_3$ is defined as the percentage change of the $SO_2$ measured before and after the chemical injection. The conversion efficiency is expressed in equation 1.

2. Mini Combustor:

This simulation combuster was used to determine the oxidation of $SO_2$ by $H_2O_2$ as an intermediate step between the bench scale and the process simulation experiments. The unit can burn gas or fuel oil at the rate of 10,000 to 30,000 BTU/Hr. and includes four major components (FIG. 2):

Fuel feeder
Burner
Furnace
Exhaust system.

The combustor was first warmed up with propane gas for ½ hour, then switched to fuel oil No. 2. When the combustor reached steady state, a required concentration of $SO_2$ gas was then injected into the furnace chamber. $H_2O_2$ solution was sprayed at the inlet of the stack gas. Measurement of the $SO_2$ concentration was done before and after the chemical injection to determine the conversion efficiency of $SO_2$ to $SO_3$ as expressed in equation 1.

3. Pilot Electrostatic Precipitator (ESP):

The pilot ESP, shown schematically in FIG. 3, was designed for the purpose of testing candidate fly ash conditioning agents. The basic components include:

Burner
Flue gas system
Fly ash feeder
Chemical feeder
$SO_2$ injector
Control panel
ESP unit.

The unit incorporates flue gas derived from a 350,000 BTU/Hr. oil burner. The tested fly ash is metered by a modified 9H miniveyor and fed into the flue gas duct at 700° F. The ESP unit is located 20 ft. downstream from the burner. It is rated at 100 SCFH and has a collector plate area of 48 ft.$^2$. The control panel features a milliamp-meter, kilovolt-meter, spark rate meter and power stat. Since the fuel oil used was low in sulfur content (0.2%S), injection of $SO_2$ gas was necessary to raise the $SO_2$ level in the flue gas to 2500 ppm.

Chemical additive, as $H_2O_2$ solution, was sprayed into the flue gas duct. An air blast nozzle was used to disperse the fine droplets of $H_2O_2$ into the gas stream. Chemical feed rate was calibrated by volume flow rate. Measurement of major species such as $O_2$, $CO_2$, CO, $NO_x$, and $SO_2$ was done continuously at the ESP inlet. Flue gas velocity in the test section was from 15 to 25 ft/sec. and the gas temperature could be adjusted from 300° F. to 500° F. Measurement of $SO_2$ concentrations was done with the Thermo Electron's $SO_2$ analyzer. The conversion efficiency is expressed in equation 1.

The results can be summarized as follows:

| Test Equipment | Additive | $SO_2$ (initial) | $SO_2$ (final) | E % |
|---|---|---|---|---|
| Bench-miniscrubber | $V_2O_5$ | 2650 | 250 | 91 |
| | $Al_2O_3$ | 3100 | 2900 | 6 |
| | MnO | 2600 | 500 | 81 |
| | $Na_2SO_4$ | 3050 | 3350 | −10 |
| | $Fe_2O_3$ | 2050 | 1150 | 44 |
| | $H_2O_2$ | 2640 | 280 | 89 |
| Minicombustor | $H_2O_2$ | 1900 | 200 | 89 |
| | Water | 2100 | 1900 | 10 |

-continued

| Test Equipment | Additive | $SO_2$ (initial) | $SO_2$ (final) | E % |
|---|---|---|---|---|
| ESP | $H_2O_2$ | 2750 | 250 | 91 |
| | $H_2O_2$ | 2500 | 250 | 90 |
| | $H_2O_2$ | 1930 | 230 | 88 |

During the last run on ESP, changes in the secondary current of the rear section were observed. They were as follows:

| | |
|---|---|
| Initial condition (with $SO_2$ injection) | 105–109 milliamp |
| Final condition (with $SO_2$ and $H_2O_2$ injection) | 148–150 milliamp |
| with $H_2O_2$ injection only: | 125–130 milliamp |

The results indicated an increasing of $SO_3/H_2SO_4$ concentration inside the ESP in the presence of $H_2O_2$.

Having thus described my invention, it is claimed as follows:

1. A method of improving the efficiency of electrostatic precipitators for removing high resistivity particulate matter from flue gases by treating said flue gases prior to contact with the electrostatic precipitator with an aqueous solution of hydrogen peroxide with the ratio of hydrogen peroxide to $SO_3$ being on a weight basis of at least 0.5/1.

* * * * *